United States Patent [19]

Lawrence et al.

[11] 4,278,538

[45] Jul. 14, 1981

[54] METHODS AND APPARATUS FOR SORTING WORKPIECES ACCORDING TO THEIR COLOR SIGNATURE

[75] Inventors: Hopeton S. Lawrence, Lawrenceville, N.J.; John D. Michalski, Levittown, Pa.

[73] Assignee: Western Electric Company, Inc., New York, N.Y.

[21] Appl. No.: 28,773

[22] Filed: Apr. 10, 1979

[51] Int. Cl.[3] ..... B07C 5/342

[52] U.S. Cl. ..... 209/580; 209/581; 209/655; 250/226; 356/405

[58] Field of Search ..... 209/580, 581, 582, 655; 250/226; 356/407, 405

[56] References Cited

U.S. PATENT DOCUMENTS

| | | | |
|---|---|---|---|
| 3,048,270 | 8/1962 | Green et al. | 209/582 X |
| 3,060,790 | 10/1962 | Ward | 209/581 X |
| 3,176,840 | 4/1965 | Bickel | 209/655 X |
| 3,476,132 | 11/1969 | Gebel | 209/582 X |
| 3,512,893 | 5/1970 | Faulhaber et al. | 250/226 |
| 3,830,401 | 8/1974 | Benwood et al. | 222/57 |
| 4,082,188 | 4/1978 | Grimmell et al. | 209/580 |
| 4,143,770 | 3/1979 | Grimmell et al. | 209/580 |

*Primary Examiner*—Joseph J. Rolla

*Attorney, Agent, or Firm*—B. W. Sheffield; D. J. Kirk

[57] ABSTRACT

Workpieces (10; FIG. 7), differing from each other only in their color, are optically sorted by illuminating the workpieces with a light beam (13) of stable color temperature. The diffuse reflection from the workpieces is analyzed by three photo-detectors, each of which is filtered to respond to a different color. Two of the colors are primary colors, as defined by the Tristimulus Theory. The third color is not a true primary color but, when added to a percentage of one of the other two colors, effectively synthesizes the third primary color. A workpiece is identified by comparing the set of Tristimulus signals it generates with a look-up table stored in the memory (25) of a microprocessor (17).

26 Claims, 12 Drawing Figures

TRISTIMULUS VALUES $\bar{r}(\lambda)$, $\bar{g}(\lambda)$, $\bar{b}(\lambda)$ OF SPECTRAL STIMULI OF DIFFERENT WAVELENGTHS TRISTIMULUS VALUES $\bar{r}(\lambda)$, $\bar{g}(\lambda)$, $\bar{b}(\lambda)$ OF SPECTRAL STIMULI OF DIFFERENT WAVELENGTHS TRISTIMULUS VALUES $\bar{x}(\lambda)$, $\bar{y}(\lambda)$, $\bar{z}(\lambda)$ DERIVED BY A LINEAR TRANSFORMATION, FROM THE TRISTIMULUS VALUES $\bar{r}(\lambda)$, $\bar{g}(\lambda)$, $\bar{b}(\lambda)$ SHOWN IN FIG. 1.

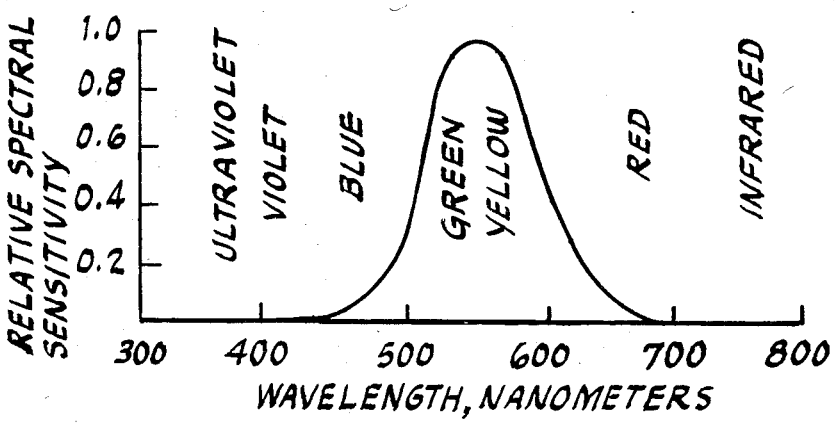
RELATIVE SPECTRAL SENSITIVITY FUNCTION OF THE HUMAN EYE
Fig. 3.
Fig. 4.
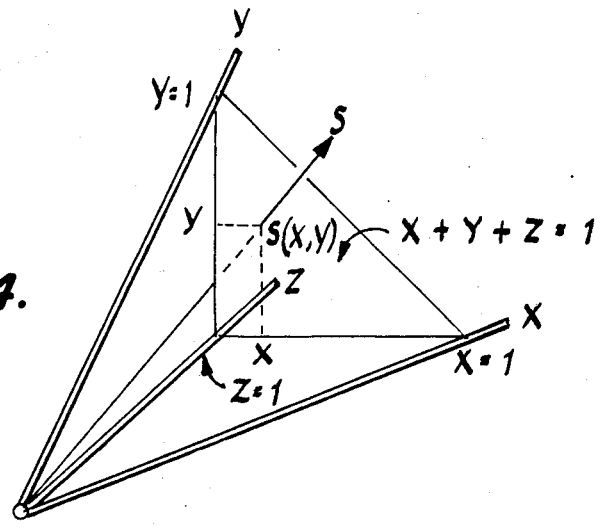
TRISTIMULUS-COLOR SPACE BASED ON THE CIE 1931 PRIMARIES X, Y, Z
$$x = \frac{X}{X+Y+Z}$$
$$y = \frac{Y}{X+Y+Z}$$
$$z = \frac{Z}{X+Y+Z}$$

CIE 1931 (x,y)-CHROMATICITY DIAG. WITH SPECTRUM LOCUS & PURPLE LINE (X,Y)-CHROMATICITY DIAGRAM: THE ELLIPTICAL LOCI CORRESPOND TO CHROMATICITIES SEPARATED FROM THE CENTRAL POINT BY THE STANDARD DEVIATION OF SETTINGS FOR CHROMATICITY MATCH.

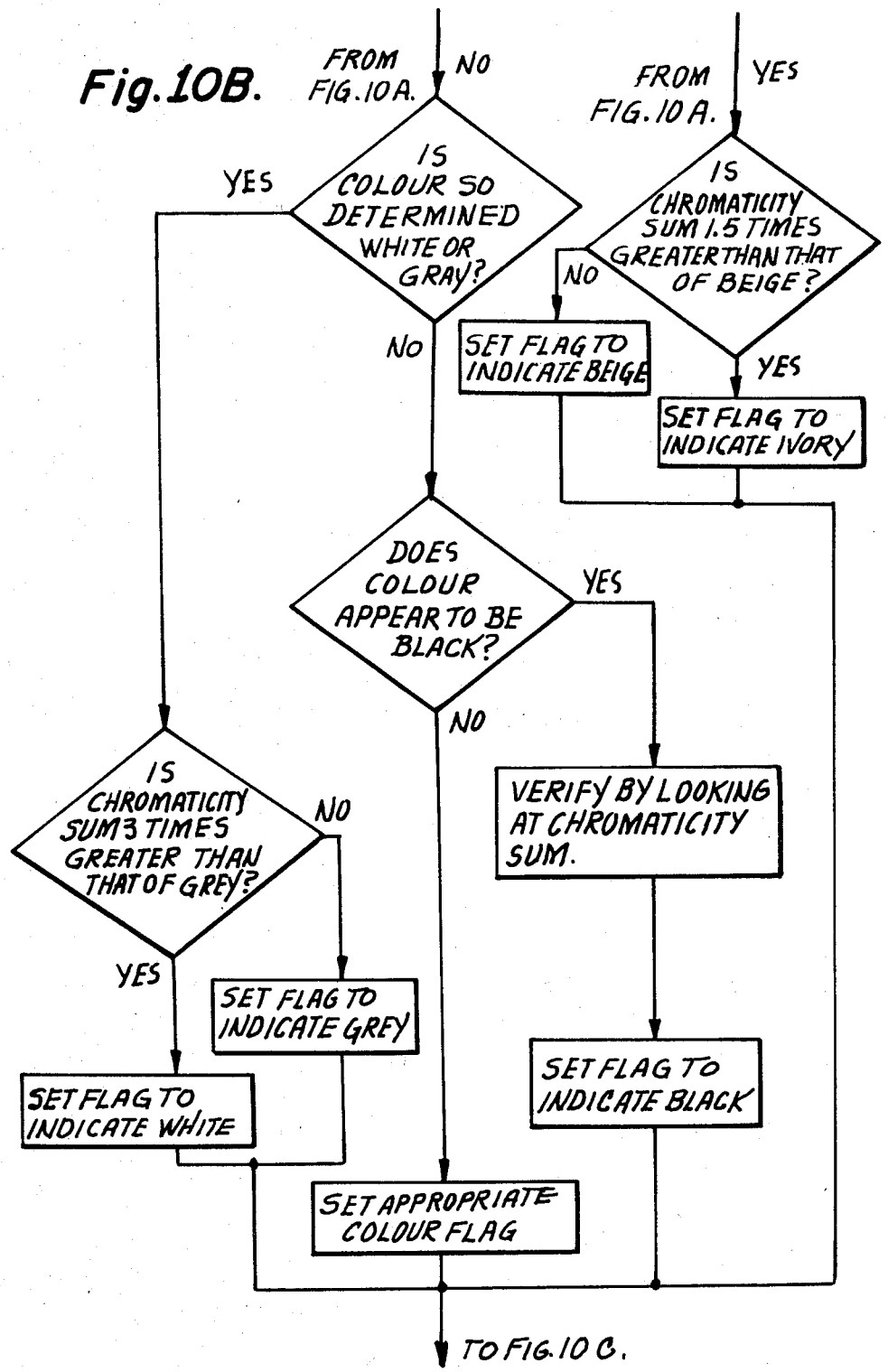
Fig. 10B.
FROM FIG. 10A.
NO
FROM FIG. 10A.
YES
IS COLOUR SO DETERMINED WHITE OR GRAY?
YES
IS CHROMATICITY SUM 1.5 TIMES GREATER THAN THAT OF BEIGE?
NO
SET FLAG TO INDICATE BEIGE
YES
SET FLAG TO INDICATE IVORY
NO
DOES COLOUR APPEAR TO BE BLACK?
YES
NO
VERIFY BY LOOKING AT CHROMATICITY SUM.
IS CHROMATICITY SUM 3 TIMES GREATER THAN THAT OF GREY?
NO
YES
SET FLAG TO INDICATE GREY
SET FLAG TO INDICATE WHITE
SET FLAG TO INDICATE BLACK
SET APPROPRIATE COLOUR FLAG
TO FIG. 10 C.

METHODS AND APPARATUS FOR SORTING WORKPIECES ACCORDING TO THEIR COLOR SIGNATURE

TECHNICAL FIELD

Broadly speaking, this invention relates to sorting. More particularly, in a preferred embodiment, this invention relates to methods and apparatus for sorting workpieces on the basis of their colour signature.

BACKGROUND OF THE INVENTION

In various industrial applications, it is frequently necessary to sort workpieces on the basis of their colour signature. This is not an easy task, especially if the workpieces are otherwise identical in size and shape. Traditionally, such sorting has been performed by human operators; however, the results have not always been satisfactory, due to the expense and time involved. In addition, after a short time interval, operator fatigue usually sets in, which leads to sorting errors. These errors are compounded if the differences in colour between the workpiece are small or if the true colour of the workpieces is masked by dirt and grime. For example, a typical operator will have difficulty in distinguishing between a blue workpiece, and a turquoise workpiece, or might mistakenly idenfity a white workpiece that is covered with grime as a beige workpiece.

Various attempts have been made to automate such sorting operations, for example, by correlating the colour of the workpiece with its coefficient of reflection. However, such attempts have not been successful because, as previously mentioned, if the workpieces are soiled, their coefficients of reflection will be diminished, leading to erroneous sorting decisions.

SUMMARY OF THE INVENTION

The problem then is to provide methods and apparatus for automatically sorting workpieces on the basis of their colour signature. It is, of course, highly desirable that such methods and apparatus be reliable, inexpensive and substantially error-free. This problem has fortunately been solved by the instant invention, which in a preferred embodiment comprises method of sorting workpieces according to their colour where said workpiece is subject to varying degrees of contamination by dirt and grime or the colour of said workpiece is determined to be close to other possible colours of the workpieces to be examined, thus rendering a positive determination difficult for certain workpiece colours. The method comprises the steps of directing a beam of light at said workpiece to illuminate the same; measuring the amplitude of three different spectral components in the light which is diffusely reflected off said workpiece, the first and second ones of said components respectively corresponding to the first and second colours of any set of three colours which satisfy the Tristimulus Theory, said third component corresponding to at least the major lobe of the third one of said set of three colours which satisfy the Tristimulus Theory; synthesizing an amplitude which substantially corresponds to the amplitude of the spectral component that would have been measured for the third one of said set of three colours which satisfy the Tristimulus Theory, by adding the amplitude of said third component to a moiety of the amplitude of said first component; comparing the amplitudes of said first and second spectral components, and said synthesized spectral component, to successive ones of a plurality of sets of spectral component amplitudes each set of which defines a possible colour for said workpiece, thereby to determine the colour of said workpiece when the results of the comparison indicate a match; summing the amplitudes of said first and second spectral components, and said synthesized spectral component; additionally comparing the sum of the amplitudes obtained in said summing step to the sum of the amplitudes in those ones of said plurality of sets of spectral component amplitudes of greater interest, thereby to positively determine the colour of said workpiece when the results of said additional comparison indicate a match. Apparatus for implementing the instant methods are also encompassed by this invention.

The invention, and its mode of operation, will be more fully understood from the following detailed description, when taken with the appended drawings in which:

DESCRIPTION OF THE DRAWING

FIG. 3 is a graph showing the relative spectral sensitivity function of the human eye;

FIG. 4 is a diagram illustrating the Tristimulus colour space based upon the CIE 1931 primaries X, Y, Z;

FIGS. 10A to C are a flow chart indicating the manner in which the microprocessor associated with the apparatus shown in FIG. 7 functions to sort by colour the workpieces supplied thereto.

DETAILED DESCRIPTION

Figure 1:
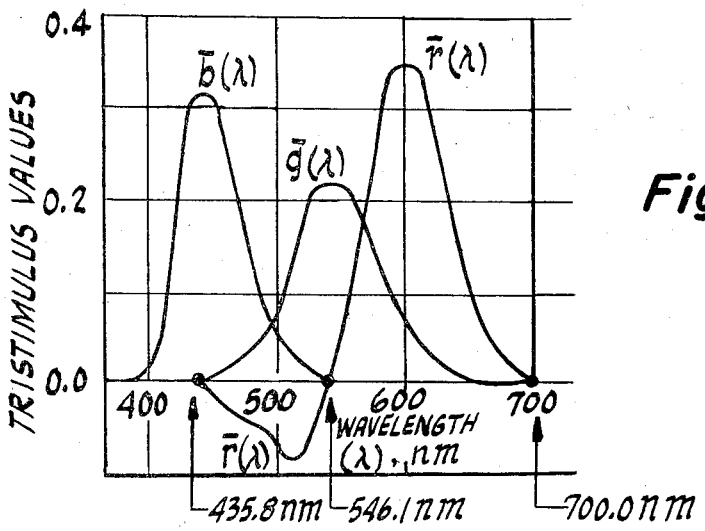
FIG. 1 is a graph showing the Tristimulus values of spectral stimuli of different wavelengths, useful in understanding the principles of the instant invention.

Although the perception of colour is one of the fundamental mechanisms by which we find out about the world around us, it turns out to be the one human sense that is not easy to synthesize from a physical standpoint. The reason for this is that colour cannot be classified as a purely physical phenomenon, nor as a purely psychological phenomenon. In point of fact, colour is the evaluation of radiant energy (physical) in terms that correlate with visual perception (psychological) and this evaluation is entirely dependent on the properties of the human eye and brain.

If then one seeks to replace a human operator by an automatic colour sorting system, the evaluation off, the radiant energy which is reflected of the workpieces to be sorted must be conducted in such a manner that the results which are obtained correlate with the visual perception that the human operator would have had. That is, the automatic system must be based on some kind of averaging of the spectral reflection of each workpiece, but the weighting accorded to the various parts of the spectrum in this average must correspond to the way that the eye of the human operator would see the colour.

The main thrust of the discussion that follows is to establish the conditions that were found necessary to make the automatic color sorting system disclosed and claimed herein compatible with the colour vision of the human eye, the eye being the ultimate judge of colour.

As is well known, a significant amount of work has been done in the area of colour identification. The approach that has been universally accepted is the CIE method of colour specification, where the letters CIE stand for Commission Internationale De l'Éclairage (International Comission for Illumination). This respected international organization recommends basic standards and procedures for all aspects of light, lighting, and illuminating engineering, which includes colorimetry, the measurement of colour.

The conditions necessary for compatibility between the automatic colour sorting system disclosed and claimed herein and the colour vision of the human eye will now be discussed. We shall also consider the surface properties of the workpieces to be sorted showing, in particular, the differences between specular and diffuse reflection and the need to isolate the latter for colour measurement. The Tristimulus approach to colour will also be discussed and we shall develop from that theory, the colour matching functions and the chromaticity diagram, which is the graphical description of colour information parameters. These conditions are all accepted by the CIE as a standard procedure for colour identification.

It is interesting to note that a normal human eye can distinguish between exceedingly small colour changes, totaling over six million different colours, when the colours are viewed in a side-by-side arrangement. However, if the colours are physically separated, so that only one of the colours can be seen at any time, the distinguishing capability of the human eye is drastically reduced and quickly reaches a level where the colour identification becomes extremely subjective. This reduction in colour identification capability is mainly caused by the loss of the reference information so that the brain is forced to identify the colour from memory.

It is this same subjective judgement plus fatigue, that limits operator performance in manual colour sorting operations. Because of these subjective factors, automatic colour sorting systems that are capable of making an objective colour identification are becoming increasingly more important to industry.

An incident light beam, upon striking the surface of a workpiece to be sorted, undergoes both specular and diffuse reflections. As is well known, a certain portion of the incident light beam undergoes a mirror reflection off the workpiece surface, preserving the spectral distribution of the incident light energy. The amount of specular reflection from the surface of the workpiece depends on the relative index of refraction below the surface of the workpiece. The behavior of the light ray is governed by Fresnel's reflection laws and so, the light tends to be quite directional, with the angles of the rays being determined by the divergence of the incident light and the surface configuration. The remaining portion of the incident light beam penetrates the surface of the workpiece and experiences absorption and multiple internal reflection. The absorption of some, or all, of the wavelengths in the light beam takes place as a result of absorbing elements or pigments contained within the workpiece. The wavelengths that are not absorbed experience scattering and multiple reflections and are finally re-emitted from the surface as diffuse reflection. This diffuse reflection is what is responsible for the colour, or colours, seen by the human eye. The diffuse light is, of course, emitted in all directions and is not dependent on the direction of the incident ray.

In order to achieve maximum colour identification, it is necessary to separate the specular and diffuse reflections and to monitor only the diffuse reflection. The reason for this is that the specular reflection preserves the spectral distribution of the incident light beam and, thus, contains no uniqueness in its spectral distribution that may be said to be representative of the colour of the workpiece.

By illuminating the workpiece normal to its surface, the specular reflection will return along the same path as the incident light beam. However, the diffuse reflection has no preferred orientation and, therefore, a measure of this reflection can be achieved by the use of photo-detectors which are positioned at angles other than normal with respect to the workpiece surface. However, as will be explained when an illustrative embodiment of the invention is discussed, an angle of 45° is preferentially maintained between the incident light beam and the photo-detectors to ensure that specular reflection due to surface roughness will not be detected.

If an observer with normal colour vision attempts to adjust one controllable element in his central visual field so that this element matches a neighbouring element in colour, the observer will ultimately discover that three, independent adjustments have to be at his disposal if matching is to be achieved. Likewise, if the observer tries to colour match one stop of light by shining several other spotlights, of different colour, onto the same neighbouring spot of a white screen, he will find, in general, that either three such colour stimuli of fixed spectral composition are required, or if two stimuli are added together, not only the amounts of both stimuli but also the spectral composition of at least one of the stimuli has to be adjustable.

If the spectral composition of the spotlight is fixed, the three colour stimuli that the observer will find necessary are independent colours, because the observer will find it impossible to reproduce the colour of any one stimulus (spotlight) by a combination of the remaining two stimuli. The three stimuli are, therefore, "primary" colours that may be used to produce most, if not all, of the remaining colours in the visible spectrum. However, it must be pointed out, that these three colours are not the only set of primary colours that could have been chosen; i.e., they are not unique.

From the above experiment, and from observation of similar experiments conducted by others, the CIE unanimously concluded that a human eye, with normal colour vision, is at least three-dimensional. That is, there must exist at least three different photosensitive pigments or filter-pigment combinations in the retina of the eye to account for human colour vision.

As previously discussed, for a colour sorting system to work effectively, the system must be compatible with the colour vision of the human eye. With this in mind, the so-called Tristimulus Theory was developed, using three primary colours. The three primary colours were chosen to be independent colours, that is to say, it is impossible to use any mixture or combination of any two of these three primary colours to obtain the third colour. One set of primaries which satisfy this condition are the monochromatic colours red (R), green (G) and blue (B) and the assumption is made in the instant invention that by combining the appropriate amount of each of these three primary colours, a perfect match for all the monochromatic colours of the visible spectrum can be obtained.

The matching of colours may be expressed in algebraic form, where a match between a colour S and the proper mixture of the three primary colours R, G, B, is conveniently given in vector notation as follows:

$$\vec{S}(r,g,b) = r\vec{R} + g\vec{G} + b\vec{B} \quad (1)$$

where r, g, and b are components of $\vec{S}$ located along the coordinate axes defined by $\vec{R}$, $\vec{G}$, and $\vec{B}$. Two colours can also be added vectorially:

$$\vec{S}_o(r_o,g_o,b_o) = \vec{S}_1(r_1,g_1,b_1) + \vec{S}_2(r_2,g_2,b_2) \quad (2)$$

where $\vec{S}_o$ is the resilient colour and $\vec{S}_1$ and $\vec{S}_2$ are the combined colours.

By expressing Equation (2) in a more explicit form:

$$\vec{S}_o(r_o,g_o,b_o) = (r_1\vec{R} + g_1\vec{G} + b_1\vec{B}) + (r_2\vec{R} + g_2\vec{G} + b_2\vec{B})$$

we obtain:

$$\vec{S}_o(r_o,g_o,b_o) = (r_1 + r_2)\vec{R} + (g_1 + g_2)\vec{G} + (b_1 + b_2)\vec{B} \quad (3)$$

A general expression for the above equations can be written in the form:

$$\vec{S}_o = \left(\sum_{i=1}^{n} r_i\right)\vec{R} + \left(\sum_{i=1}^{n} g_i\right)\vec{G} + \left(\sum_{i=1}^{n} b_i\right)\vec{B},\ i=1,2,3,4 \quad (4)$$

From the general expression it can be seen that, if the assumption concerning the three-primary mixture is correct, all the colours of the visible spectrum can be matched, including white, since white is a sum of all the monochromatic colours.

The specification of colours by the Tristimulus method gives rise to a concept that many workers in the field find puzzling. This concept is the appearance of negative numbers in the specification of a colour by the Tristimulus method. For example, in the vector equation:

$$\vec{S} = -3\vec{R} + 4\vec{G} + 4\vec{B}, \quad (5)$$

the red primary colour has a negative coefficient. From a purely mathematical point of view, this equation is completely acceptable but, from a real life point of view, a negative red primary cannot, of course, be realized. However, if the combination $\vec{S}+3\vec{R}$ matches the combination $4\vec{G}+4\vec{B}$, then Equation (5) can be rewritten as:

$$\vec{S} + 3\vec{R} = 4\vec{G} + 4\vec{B}, \quad (6)$$

which makes the coefficients of the primaries R, G and B all positive. Equation (6) indicates that a match is being obtained, but not a match of the original colour S. This equation also indicates that, in fact, there may be a practical limitation to three-primary matching of colours and this limitation will be clarified later in the discussion.

At this point it is instructive to describe a special colour matching experiment that was conducted by the CIE. This experiment was designed to determine the colour matching functions of an observer with normal colour vision, using a visual colorimeter with monochromatic stimuli.

A monochromatic stimulus is a radiant flux comprising a very narrow band of wavelengths, $\Delta\lambda$, having a central wavelength of $\lambda$. A typical wavelength band, $\Delta\lambda$, is 5 nm wide and we are interested in all such wavelength bands which, when joined together, define a continuous spectrum from approximately 380 nm to 770 nm.

The colorimeter used in the CIE experiment had four monochromators; three to generate the three primary stimuli and one to produce the test stimulus. The monochromators were installed in a fixed relationship but provision was made for moving them individually, from one side of the apparatus to the other. The three primary stimuli were set at $\lambda_R=700.0$ nm for red (R); at $\lambda_G=541.1$ nm for green (G); and at $\lambda_B=435.8$ nm for blue (B). These primaries were chosen such that their radiances were in the ratios $L_R:L_G:L_B=72.1:4.1:1.0$ (approx.). That choice was made as the result of an auxiliary experiment which established that the colour that results from a mixture comprising unit amounts of the primary colours matches the colour of an equal-energy stimulus. An equal-energy stimulus may be thought of as an additive mixture of all the monochromatic stimuli making up a continuous spectrum from 380 nm to 770 nm, where each monochromatic stimulus has the same radiance $L_{o\lambda}\Delta\lambda$. This equal energy stimulus is seen as white light by an observer.

The set of stimuli of wavelength $\Delta$ which made up the equal-energy spectrum also served as test stimuli as they were looked at by the observer, one by one, from $\lambda=380$ nm to 770 nm, at intervals of $\Delta\lambda=5$ nm. There were a total of 79 test stimuli of constant radiance and all were provided by one of the four monochromators.

In making actual colour matches between the three primary stimuli and the test stimulus, it was discovered that it was not practical, and in fact not necessary, to maintain each test stimulus at a constant radiance. In fact, it was found desirable to increase the radiance of the test stimuli near the ends of the visible spectrum in order to provide a more convenient stimulus magnitude and assure photo-optic vision (i.e. vision activated by the cone mechanism in the retina). If the radiance of the test stimulus is known at the colour match, the amount of the primary colours that would apply to a test stimulus of the same wavelength, but different radiance, can be readily deduced. Let $L_\lambda\Delta\lambda$ be the radiance at match and $L_{o\lambda}\Delta\lambda$, be the radiance to which the match is to apply. Then, the amounts $R(\lambda)$, $G(\lambda)$, $B(\lambda)$ of the primaries, called Tristimulus values, obtained in the match must be multiplied by the quotient $L_{o\lambda}\Delta\lambda/L_\lambda\Delta\lambda$. The result is a set of new Tristimulus values, $\bar{r}(\lambda)$, $\bar{g}(\lambda)$ and $\bar{b}(\lambda)$ which apply to stimuli of wavelength $\lambda$ of constant radiance $L_{o\lambda}\Delta\lambda$.

The observer used in this experiment viewed a bipartite visual field and made adjustments to the four stimuli to obtain a colour match. The visual field subtended an angle of two degrees on the observer's eye which is the maximum field size that can be used if the observer's view is to be restricted to foveal vision. This is desired because the eye has its most accurate colour vision when light is focused on to the foveal pit of the retina, the foveal pit having, of course, the maximum concentration of cones.

The results of this experiment are listed in Table I for a selected number of values

TABLE I

Average color-matching functions $\bar{r}(\lambda)$, $\bar{g}(\lambda)$, $\bar{b}(\lambda)$ of observers with normal colour vision viewing a 2 visual field. The monochromatic primaries R (700.0nm). G (546.1nm), B (435.8nm) have radiances in the ratios $L_R$: $L_G$: $L_B$ = 72.1 : 1.4 : 1.0 (approx.).

| Constant Radiance Test Stimulus at Wavelength λ(nm) | Colour-Matching Functions (Spectral Tristimulus Values) $\bar{r}(\lambda)$ | $\bar{g}(\lambda)$ | $\bar{b}(\lambda)$ |
|---|---|---|---|
| 380 | 0.00003 | −0.00001 | 0.00117 |
| 420 | 0.00211 | −0.00110 | 0.11541 |
| 460 | −0.02608 | 0.01485 | 0.29821 |
| 500 | −0.07173 | 0.08536 | 0.04776 |
| 540 | −0.03152 | 0.21466 | 0.00146 |
| 580 | 0.24526 | 0.13610 | −0.00108 |
| 620 | 0.29708 | 0.01828 | −0.00015 |
| 660 | 0.05932 | 0.00037 | 0.00000 |
| 700 | 0.00410 | 0.00000 | 0.00000 |
| 740 | 0.00025 | 0.00000 | 0.00000 |

Each row in the above table gives the test stimulus of wavelength $\lambda$, and the measured Tristimulus values $\bar{r}(\lambda)$, $\bar{g}(\lambda)$ and $\bar{b}(\lambda)$, respectively. Note that in many cases, one of the Tristimulus values is negative, indicating that the colour matched was actually obtained by using one of the primaries to desaturate the test stimulus. In other cases, one or two of the Tristimulus values are zero, indicating that the colour match was obtained, respectively, by the use of two primaries or one primary only.

The spectral Tristimulus values $\bar{r}(\lambda)$, $\bar{g}(\lambda)$ and $\bar{b}(\lambda)$ of the monochromatic (spectral) stimuli for different wavelengths but constant radiance, are appropriately called colour matching functions with respect to the given primaries R, G, and B. FIG. 1 illustrates these functions, as drawn from the data given in Table I. The wavelength $\lambda$ of the test stimuli and the primaries are given on the abscissa, and the Tristimulus values of the test stimuli for constant radiance are given on the ordinate. As will be observed, the functions are continuous and fairly smooth, showing partly negative and partly positive lobes with transitions at the wavelengths of the primary stimuli.

One of the objectives of the instant invention is to develop a set of band-pass filters that will provide maximum color identification throughout the visible spectrum. The colour matching functions shown in FIG. 1 appear to be the answer to the development of this set of band-pass filters because, for each stimulus, the $\bar{r}(\lambda)$, $\bar{g}(\lambda)$ and $\bar{b}(\lambda)$ values are unique. However, certain values of $\bar{r}(\lambda)$, $\bar{g}(\lambda)$ and $\bar{b}(\lambda)$ are negative and, as will be appreciated, it is impossible to construct an actual band-pass filter having negative transmission characteristics.

It is, therefore, necessary to develop a new set of colour matching functions with all positive values. To that end a new set of primaries X, Y, Z is chosen. These are imaginary primaries that do not exist physically and are derived from the real R, G, B primaries by way of linear transformation.

If the Tristimulus values of any colour for the first triad of primaries are found to be R, G, B, the Tristimulus values X, Y, Z of the same colour for the second triad of primaries are given by:

$$\begin{aligned} \vec{X} &= X_r\vec{R} + X_g\vec{G} + X_b\vec{B} \\ \vec{Y} &= Y_r\vec{R} + Y_g\vec{G} + Y_b\vec{B} \\ \vec{Z} &= Z_r\vec{R} + Z_g\vec{G} + Z_b\vec{B} \end{aligned} \tag{7}$$

where $X_r$, $Y_r$, and $Z_r$ are the amounts of the second triad of primaries required to match the colour (R=1, G=0, B=0); $X_g$, $Y_g$, $Z_g$ are the amounts required to match the colour (R=0, G=1, B=0); and $X_b$, $Y_b$, $Z_b$ are the amounts required to match the colour (R=0, G=0, B=1).

Figure 2:
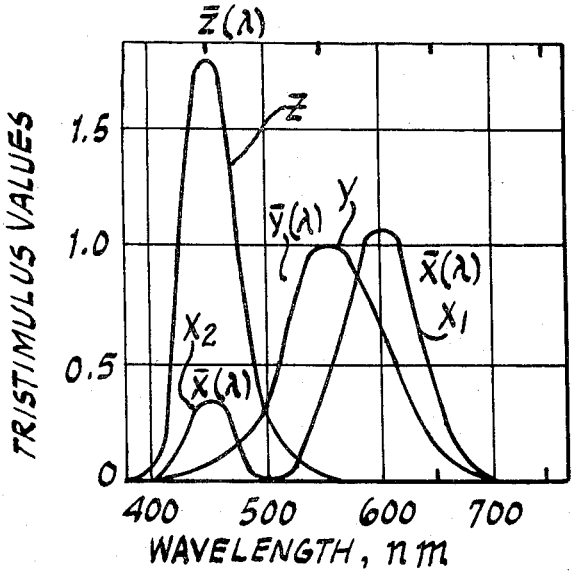
FIG. 2 is a graph showing the Tristimulus values of spectral stimuli of different wavelengths derived by linear transformation from the Tristimulus values shown in FIG. 1.

As shown in FIG. 2, a new set of colour matching functions $\bar{x}(\lambda)$, $\bar{y}(\lambda)$, and $\bar{z}(\lambda)$ with all positive values was derived from the above-discussed linear transformation. There are many linear transformations from which this choice could have been made, but all are characterized by the fact that the primaries to which the new colour matching functions must then refer are non-real or imaginary; and, thus, only of mathematical importance. The particular linear transformation that was chosen to convert the colour matching functions $\bar{r}(\lambda)$, $\bar{g}(\lambda)$, and $\bar{b}(\lambda)$ to the CIE 1931 standard colour matching functions $\bar{x}(\lambda)$, $\bar{y}(\lambda)$, and $\bar{z}(\lambda)$ is not only aimed at making $\bar{x}(\lambda)$, $\bar{y}(\lambda)$ and $\bar{z}(\lambda)$ positive functions, but also at including other features convenient for colourimetric calculations. Importantly, as shown in FIG. 3, the curve of the $\bar{y}(\lambda)$ colour matching function is identical to the curve for the relative spectral sensitivity of the human eye.

By the use of the three newly defined colour matching functions, $\bar{x}(\lambda)$, $\bar{y}(\lambda)$, and $\bar{z}(\lambda)$, we are now able to define colours numerically, for easy identification. For a given monochromatic or polychromatic colour, the Tristimulus values X, Y, Z, of the three primaries $\vec{X}$, $\vec{Y}$, $\vec{Z}$ can be calculated in a straightforward manner; however, to avoid unduly burdening the reader, the actual calculations will be postponed until later in the discussion.

The linear transformations discussed above ensure that the Tristimulus values, X, Y, Z will always be positive. Therefore, any real colour which is represented by the three primaries X, Y, Z will lie in the positive quadrant of a three-dimensional or Tristimulus-colour space. To avoid amplitude book-keeping for identical colours, the three primaries are advantageously normalized to unity, which allows the mapping of all real colours into a unit plane.

FIG. 4 shows a geometric model of the Tristimulus-colour space defined by X, Y, Z. The unit plane $X+Y+Z=1$, is called the chromaticity diagram. Note that the geometric arrangement is such that the chromaticity diagram is a right triangle. A given colour S intersects the unit plane at S(x,y), called a chromaticity point, the location of which is specified by the chromaticity coordinate x,y. The chromaticity coordinates x, y, z in the $\vec{X}$, $\vec{Y}$, $\vec{Z}$ system are related to the Tristimulus values X, Y, Z by the relations:

$$x = \frac{X}{X+Y+Z} \quad y = \frac{Y}{X+Y+Z} \quad z = \frac{Z}{X+Y+Z} \tag{8}$$

with $x+y+z=1$. Since the unit plane is a right triangle, the rectangle chromaticity coordinates x,y are sufficient to specify the chromaticity point of any colour S.

Figure 5:
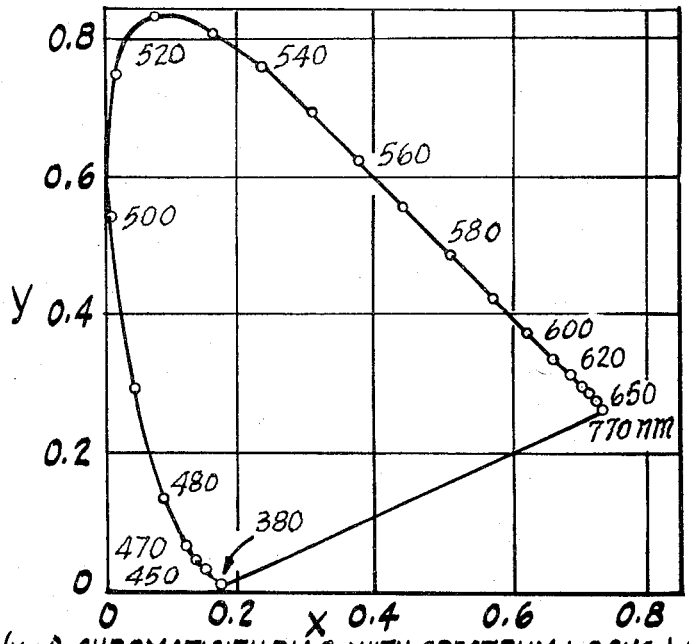
FIG. 5 is the CIE 1931 chromaticity diagram showing the spectrum locus and Purple Line.

As shown in FIG. 5, when the colours S(λ) of monochromatic stimuli of wavelength λ, with λ ranging from the short-wave end (380 nm) to the long-wave end (770 nm) of the visible spectrum, are plotted on the chromaticity diagram they intersect the unit plane in points lying along a line which is both partially curved and partially straight. This line, commonly called the spectrum locus in the chromaticity diagram, begins at 380 nm and ends at 770 nm. The straight line connecting the chromaticity points S(λ=380 nm) and S(λ=770 nm) is a result of mixing the stimuli of wavelength λ=380 nm (Blue) and λ=770 nm (Red) in varying amounts. This line is sometimes called the Purple Line.

The set of monochromatic colours S(λ), and the additive mixtures of S(λ=380) and S(λ=770), form a cone in the Tristimulus space within which the colours of all additive mixtures of monochromatic stimuli must fall. This cone is the boundary of all real colours. Colours that fall outside this space are often referred to as imaginary colours. The primaries X, Y, Z are important examples of imaginary colours.

To decide whether a given colour S is real or imaginary, if suffices to determine the location of the chromaticity point S(x,y) of S in the chromaticity diagram shown in FIG. 5. If S falls inside the area bounded by the spectrum locus and the Purple Line (or coincides with any point on the spectrum locus or Purple Line), it follows that S is a real colour. If S(x,y) falls outside this area, S is an imaginary colour. Since the workpieces to be sorted by the methods and apparatus of this invention are real workpieces, they have real colours; hence, they will all fall within the area bounded by the spectrum locus and the Purple Line.

The equal energy stimulus colour has the chromaticity coordinates $x=y=z=\frac{1}{3}$, which is a point located in the center of the unit plane. This results from an arbitrary but convenient normalization of the unit lengths of the primaries X, Y, Z, in the Tristimulus-colour space. As a consequence of this normalization, it will be noted that the areas under the three colour-matching functions $\bar{x}(\lambda)$, $\bar{y}(\lambda)$, and $\bar{z}(\lambda)$ shown in FIG. 2 are all equal.

We shall now outline the procedure employed in the instant invention to determine the Tristimulus values of a given colour stimulus. The fundamental property that is responsible for the colour of a workpiece is the spectral transmittance, T(λ), for a transparent workpiece; and the spectral reflectance factor, β(λ), for an opaque workpiece. The measure of the spectral transmittance, or spectral reflectance factor, is obtained by using the appropriate spectrophotometer. Since this invention is concerned exclusively with opaque workpieces, no further consideration will be given to the spectral transmittance, T(λ).

To correctly identify the colour of a workpiece prior to sorting, adequate illumination of the workpiece must be provided. If a change in the illumination is made, the colour of the workpiece being viewed will also change. This change in colour is related to the differences in the spectral power distribution of the illumination being used. Colour changes for a given workpiece can be demonstrated by using a colorimeter with a bipartite field, illuminated by two different light sources. Suggested light sources for this experiment are tungsten and fluorescent lamps. As a result of the three previous statements it is, therefore, necessary to specify the type of illumination used when making colour identifications. A more accurate specification of the illumination is in terms of its relative spectral power distribution, S(λ), which can also be measured by a spectrophotometer.

The quantities, S(λ) and Δλ define the spectral radiant flux incident on a workpiece per unit area of the workpiece and within a small wavelength interval Δλ containing λ. When an opaque workpiece is viewed, the spectral radiant flux that reaches the photo-detector is given by:

$$Q(\lambda)\Delta\lambda = \beta(\lambda)S(\lambda)\Delta\lambda \tag{9}$$

The relative power distribution, Q(λ)Δλ, defines the object-colour stimulus and it is the object-colour stimulus for which the Tristimulus values will be determined.

The spectral components of the object-colour stimulus, Q(λ)Δλ, usually will not form an equal-energy spectrum but will, rather, form a spectrum whose components vary strongly in radiant power with wavelength. However, to obtain the spectal Tristimulus values for each such component, the following products are formed:

$$Q(\lambda)\,\bar{x}(\lambda)\Delta\lambda,\ Q(\lambda)\bar{y}(\lambda)\Delta\lambda,\ \text{and}\ Q(\lambda)\bar{z}(\lambda)\Delta\lambda \tag{10}$$

for all wavelengths λ. We recall that $\bar{x}(\lambda)$, $\bar{y}(\lambda)$ and $\bar{z}(\lambda)$ are the Tristimulus values for each spectral stimulus of wavelength λ of an equal-energy spectrum and, when plotted as three functions of wavelength, they define the colour-matching properties of the CIE 1931 standard colorimetric observer.

The Tristimulus values of the complete spectrum of our given object-colour stimulus Q(λ)Δλ, are obtained by adding the corresponding Tristimulus values for all wavelengths. They are as follows:

$$X = k\sum_{\lambda} Q(\lambda)\bar{x}(\lambda)\Delta\lambda \quad Y = k\sum_{\lambda} Q(\lambda)\bar{y}(\lambda)\Delta\lambda \quad Z = k\sum_{\lambda} Q(\lambda)\bar{z}(\lambda)\Delta\lambda \tag{11}$$

where k is the normalizing factor and is conveniently chosen as:

$$k = \frac{100}{\sum_{\lambda} S(\lambda)\,\bar{y}(\lambda)\Delta\lambda} \tag{12}$$

The Tristimulus values of a self-luminous colour stimulus may also be calculated by means of Equation (10), the only difference being that for a self-luminous color stimulus we have simply:

$$Q(\lambda)\Delta\lambda = S(\lambda)\Delta\lambda. \tag{13}$$

In this case, the relative spectral power distribution S(λ) defines the colour stimulus.

The chromaticity coordinates x, y, z are related to the Tristimulus values X, Y, Z by the relations:

$$x = \frac{X}{X+Y+Z} \quad (14)$$
$$y = \frac{Y}{X+Y+Z}$$
$$z = \frac{Z}{X+Y+Z},$$

where x and y are sufficient to specify the chromaticity point in the chromaticity diagram.

The identification of the colour of the workpieces to be sorted in the instant invention can be achieved by use of the information presented above whereby the chromaticity coordinates x and y of the workpiece are calculated and mapped into the chromaticity diagram shown in FIG. 5. From the location of the chromaticity point plotted, the colour of the workpiece can easily be determined, provided, of course, that the chromaticity diagram used is represented visually with its full spectrum of colours.

It must be pointed out, however, that a single point in the chromaticity diagram does not offer sufficient information to positively determine whether or not the colour identification of the workpiece falls within the boundary that provides a satisfactory match for the desired colour.

By observing the chromaticity diagram with all of its colour, one will find it almost impossible to establish definite boundaries between colours, such as blue and green, green and yellow and so on. Each colour in the visible spectrum has numerous shades which allows it to blend into its neighbouring colours, forming a continuous spectrum of colour. Recall also that, when all colours are present, the spectrum is identified as white light. As a practical matter for most colour identification requirements, it is therefore insufficient to specify colours as merely blue, green, yellow, etc.

Taking these facts into consideration, it has been found necessary to specify the chromaticity coordinates for a perfect match of colour to be identified. Then, from these specified chromaticity coordinates, a boundary or range of colours that form acceptable matches can be determined experimentally. The experimental determination of the boundary of acceptable matches is geared to the degree of accuracy required to satisfy the needs of the particular colour sorting system. For example, consider a colour sorting system that is required to identify and sort workpieces of only ten, widely-spaced, colours, and having a low degree of colour matching accuracy. The acceptable boundary of each colour can be constructed in the form of circles, ellipses or squares, with the chromaticity coordinates (x and y) for a perfect match being located at the centers of the circles, ellipses or squares. Note that all the circles, ellipses or squares will not be of the same size, because the chromaticity diagram is not a uniform colour space.

If a high degree of colour matching accuracy is required, the boundaries should be constructed from chromaticity points that correlate to a set of calculated colour differences. This is due to the fact that the chromaticity diagram does not represent a uniform colour space. The colour difference ($\Delta E$) is calculated from a uniform (or almost uniform) three-dimensional colour space (L,a,b) and by plotting chromaticity points that correspond to $\Delta E$ points in the uniform colour space. Using this technique, boundaries that satisfy a high degree of colour-matching accuracy can be constructed. The colour difference formula is given by $$E\Delta\,(L,a,b) = [(\Delta a)^2 + (\Delta b)^2 + (\Delta L)^2]^{\frac{1}{2}} \quad (15)$$

where $$L = 25\left(\frac{100Y}{Y_o}\right)^{\frac{1}{3}} - 16\ (1 \leqq Y \leqq 100)$$

$$a = 500\left[\left(\frac{X}{X_o}\right)^{\frac{1}{3}} - \left(\frac{Y}{Y_o}\right)^{\frac{1}{3}}\right]$$

$$b = 200\left[\left(\frac{Y}{Y_o}\right)^{\frac{1}{3}} - \left(\frac{Z}{Z_o}\right)^{\frac{1}{3}}\right]$$

$$L_c = 25\left(\frac{100Y}{Y_o}\right)^{\frac{1}{3}} - 16\ (1 \leqq Y_c \leqq 100)$$

$$a_c = 500\left[\left(\frac{X_c}{X_o}\right)^{\frac{1}{3}} - \left(\frac{Y_c}{Y_o}\right)^{\frac{1}{3}}\right]$$

$$b_c = 200\left[\left(\frac{Y_c}{Y_o}\right)^{\frac{1}{3}} - \left(\frac{Z_c}{Z_o}\right)^{\frac{1}{3}}\right], \text{ where}$$

Figure 6:
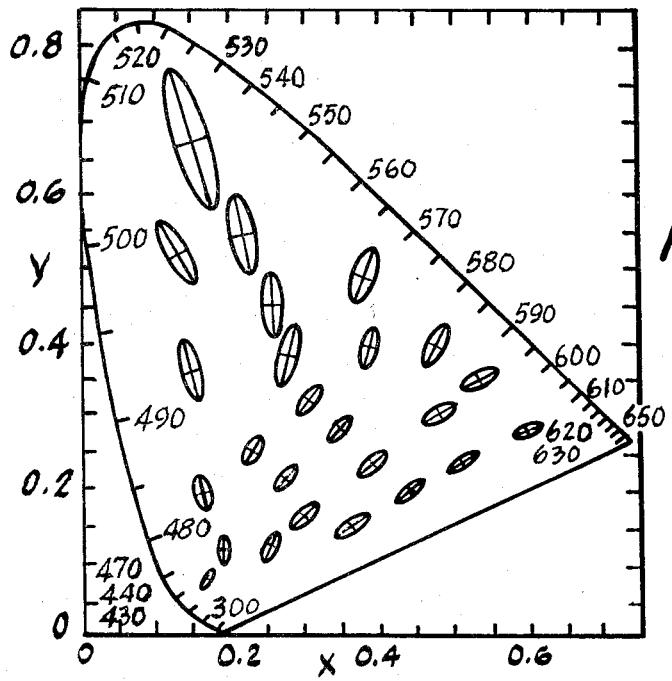
FIG. 6 is a graph showing the chromaticity diagram with elliptical loci corresponding to chromaticities separated from the central point by the standard deviation of settings for chromaticity match.

X, Y, Z are the Tristimulus values of the colour on the boundary and $$\Delta L = L - L_c$$
$$\Delta a = a - a_c$$
$$\Delta b = b - b_c,$$

where the subscript c denotes the centroid colour, i.e., the perfect match. In these equations, the Tristimulus values $X_o$, $Y_o$, and $Z_o$ define the colour of the nominally white object-color stimulus. FIG. 6 shows the elliptical loci that correspond to chromaticities separated from the central point by the standard deviation of setting for chromaticity match. For illustration purpose, the axes of each ellipse have been enlarged ten times. Note that the ellipses are of different sizes, due to the non-uniformity of the chromaticity diagram.

A specific illustrative embodiment of the invention will now be described in detail. The operating environment for this embodiment comprises the sorting of the exterior plastics components of a telephone. For example, these components might comprise the transmitter and receiver end caps which must be sorted by colour prior to refurbishing and repainting. As might be expected, these workpieces are received from the field in varying states of cleanliness which, as mentioned previously, affects the ease with which they may be colour-sorted. The end caps come in the eleven standard telephone colours i.e., red, green, blue, yellow, beige, ivory, black, white, turquoise, pink and grey. One skilled in the art will appreciate, however, that the invention is not limited to this type of workpiece or to these particular colours; indeed, it may in general be used with any type of workpiece, of any colour. Other possible uses of this invention are the sorting of telephone instruments themselves, as well as automatically identifying individual wires in a multi-coloured plastic insulated cable, as widely used in the telephone industry.

Figure 7:
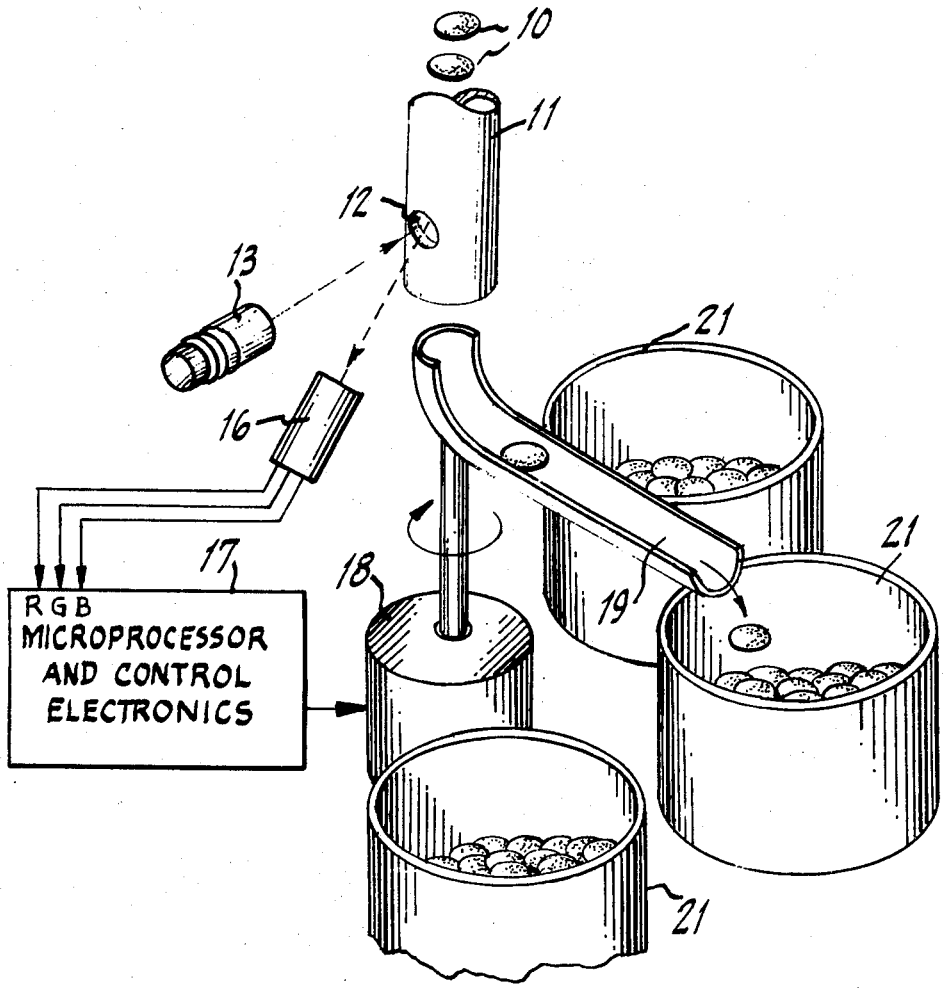
FIG. 7 is a partially schematic, partially diagrammatic, isometric view depicting an illustrative sorting apparatus according to the invention.

FIG. 7 depicts an illustrative embodiment of the invention for sorting telephone caps. As shown, the caps 10 to be sorted are dropped from some suitable hopper (not shown) into a vertically aligned, cylinder 11 having an aperture 12 therein. A source of light 13 illuminates the workpieces through the aperture 12 and the light which is reflected from the workpieces passes back out through aperture 12 to impinge upon a detector assembly 16, which will be described in greater detail subsequently. Detector assembly 16 has three outputs which are fed to a microprocessor and control circuit 17 which, in turn, is connected to, and controls, the rotation of a motor 18. A chute 19 is fastened to the upper end of the motor shaft for rotation therewith. The upper end of chute 19 is positioned to receive the caps as they drop out of cylinder 11. As will be explained, the lower end of chute 19 is selectively positioned by motor 19 to align with any of several bins 21, each of which receives telephone caps of the same color.

Figure 8:
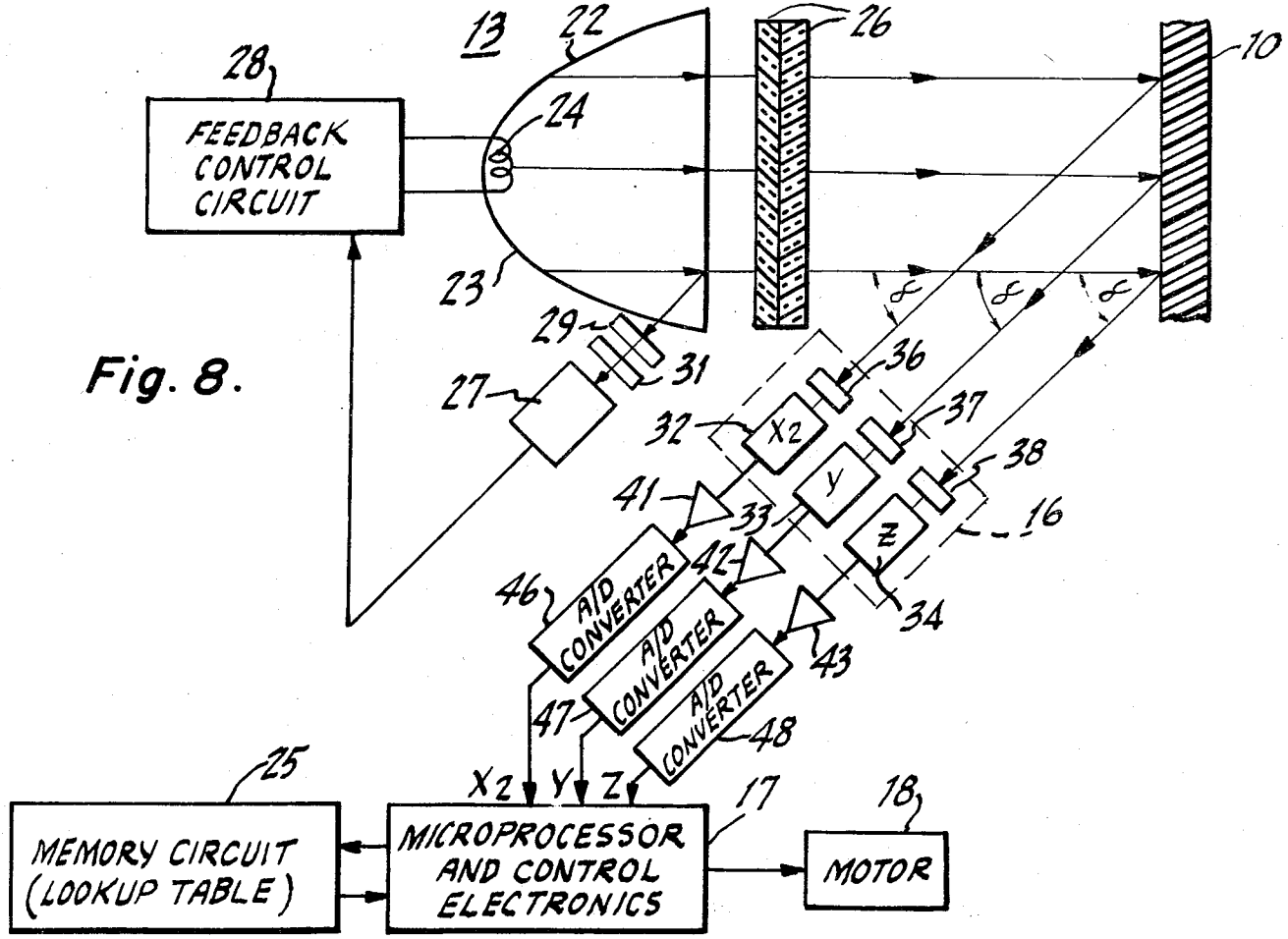
FIG. 8 is a partially schematic, partially diagrammatic, cross-sectional view depicting the light source and the photo-detectors used in FIG. 7 in greater detail.

FIG. 8 depicts light source 13 and detector assembly 16 in greater detail. As shown, light source 13 comprises a quartz-halogen lamp 22 having a built-in parabolic reflector 23 which concentrates the beam of light produced by a filament 24. The quartz-halogen lamp emits most of its energy in wavelengths which are longer than 770 nm. This energy is, thus, primarily infra-red energy and contains no colour information because the visible spectrum has only a limited wavelength range of from 380 nm to 770 nm. The infra-red energy output from lamp 22 is eliminated by positioning a pair of infra-red filters 26—26 directly in front of reflector 23. These filters absorb the infra-red energy from the lamp and ensure that only visible light impinges upon the workpiece. In one embodiment of the invention actually built and tested, the reflector of lamp 22 had a focal length of 1.5 inches and, when focused, produced a spot on the surface of a telephone cap in cylinder 11 which had a diameter of 0.5 inches.

As is well known, accurately measuring colour over an extended period of time requires that the illuminating source be maintained at a constant colour temperature. In the illustrative embodiment of the invention, this is accomplished by the use of a feedback control circuit 28 which is connected to the output of a photo-detector 27 positioned to receive a small fraction of the light generated by lamp 22. An infra-red filter 29, positioned in the optical path of photo-detector 27, absorbs the unwanted infra-red radiation. A narrow-band, blue filter 31 is also positioned in the optical path of photo-detector 27 to limit the response of the photo-detector to a very narrow band of wavelengths, rather than the entire visible spectrum. Feedback control circuit 28 controls the amount of current fed to filament 24. If the current through filament 24 should fall, for some reason, the colour temperature of the light output from lamp 22 will change. This change will be detected by photo-detector 27 and fed back to control circuit 28 which will increase the current through filament 24, in an offsetting manner, so that the colour temperature of lamp 22 is held substantially constant. The reason that a narrow-band, blue filter is positioned in the optical path of photo-detector 27 is that if detector 27 were sensitive to all of the frequencies in the output beam from lamp 22, it would take a far greater change in colour temperature before control circuit 28 could determine that an increase or decrease in the current supplied to filament 24 were necessary.

Figure 9:
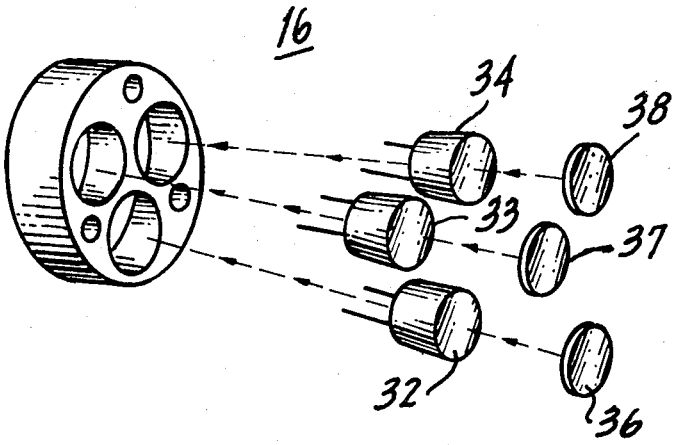
FIG. 9 is an exploded view showing the arrangement of the photo-detectors in FIG. 8 in greater detail.

As shown, detector assembly 16 comprises three substantially identical photo-detectors 32, 33 and 34 each of which has a colour filter 36, 37 and 38, respectively, associated therewith. The detectors 32–34 in FIG. 8 are shown side by side in a linear array. In actual fact, as shown in the exploded view in FIG. 9, they are advantageously arranged in a triad. Turning back, momentarily, to FIG. 2 it will be seen that the set of Tristimulus band-pass filters required to optimize the identification of colours present throughout the visible spectrum, have spectral transmission characteristics which are defined by well-behaved mathematical functions. The Y and Z curves each have a single lobe and can therefore be manufactured at relatively low cost. The X filter, on the other hand, requires a considerably more complex function to define its transmission characteristics. As shown, the X filter may be considered as having two lobes, $X_1$ and $X_2$, and the combination of these two lobes into a single filter requires a highly controlled manufacturing process. This means that the X filter has a significantly higher cost than the Y and Z filters. In fact, a set of three filters having the characteristics shown in FIG. 2 costs well over $5,000. It would, of course, be possible to use a detector assembly having four detectors and four filters respectively having characteristics corresponding to the Z, Y, $X_1$ and $X_2$ transmission curves. However, this would considerably complicate the physical design of the detector assembly and is not an attractive solution.

The instant invention, is based on the discovery that the Z and $X_2$ characteristics have approximately the same shape. Thus, an alternative method of synthesizing the characteristics of the X filter, which results in considerable economy without any sacrifice of colour identification accuracy, is achieved by choosing a filter which matches the transmission characteristics of the $X_1$ lobe alone and then adding to that characteristic a small percentage, say 12%, of the transmission characteristic of the Z filter, as a substitute for the $X_2$ lobe. The following equations will clarify the above relationships:

$$X = X_1 + X_2 \quad (16)$$
$$X_2 = 0.12Z \quad (17)$$
$$X = 0.12Z + X_1. \quad (18)$$

Figure 10A:
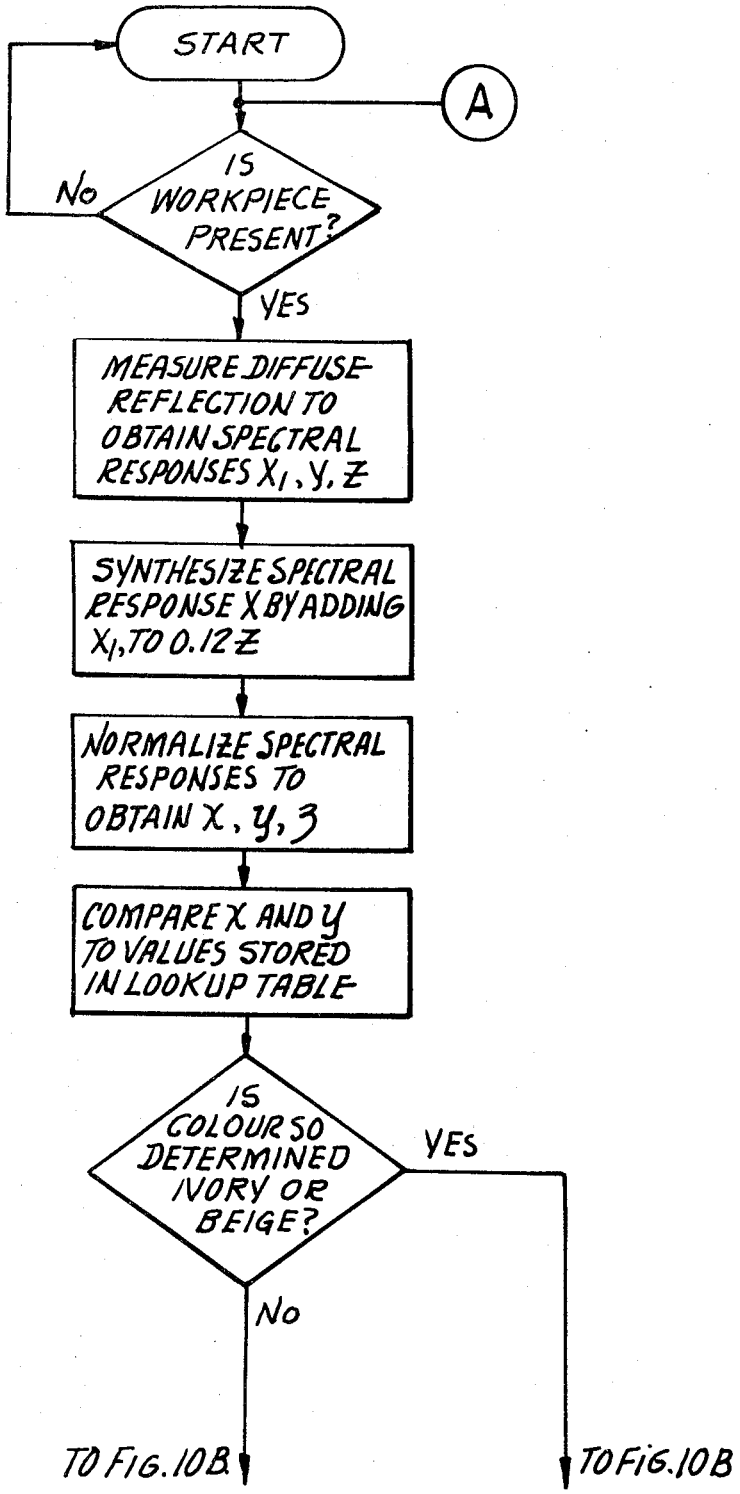
Figure 10C:
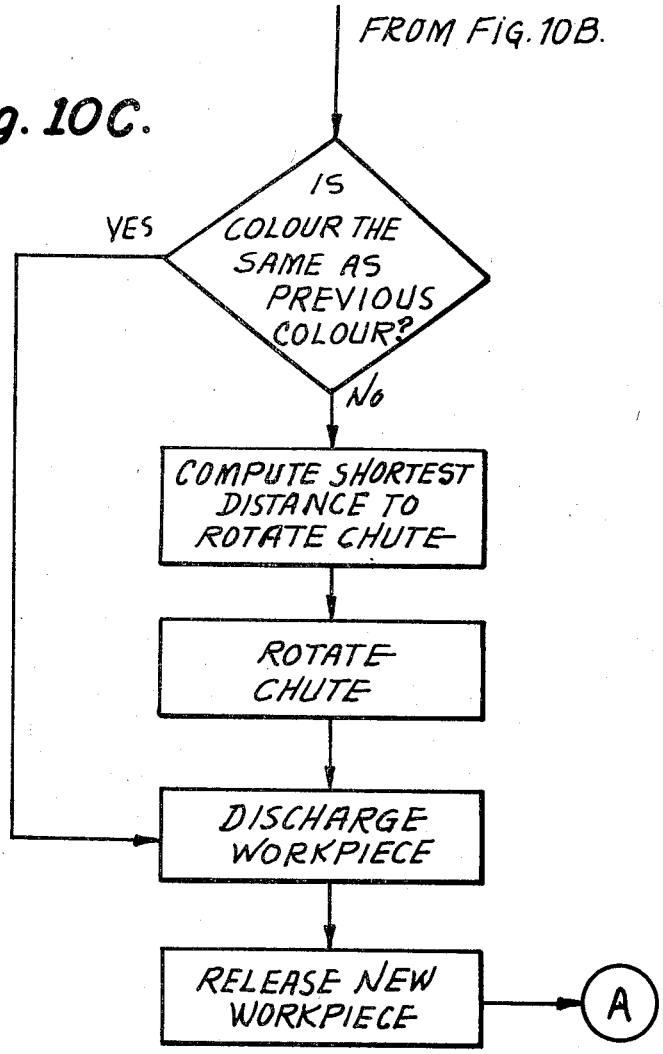

The two arithmetic operations, i.e., multiplying the output of the detector associated with the Z filter by 0.12 and then summing the value so obtained with the output of the photo-detector associated with the $X_1$ filter, are advantageously performed by a microprocessor 17 although it will be evident to one skilled in the art that they can also be performed by hand-wired circuitry. As previously mentioned, in order to achieve an accurate colour identification for each workpiece, it is necessary to separate the specular and the diffuse reflection and monitor only the diffuse. The reason for this is that the specular reflection preserves the spectral distribution of the incident light beam and therefore contains no information that is a unique representation of the colour of the workpiece. The separation of the specular and diffuse reflections is achieved by illuminating the surface of the workpiece with a light beam of normal incidence. The specular reflection, i.e., the surface reflection, follows the reverse path of the light beam of normal incidence and is therefore totally accounted for. The diffuse reflection, on the other hand, has no preferred orientation and a measure of this reflection is achieved by positioning the detectors 32 through 34 at an angle $\alpha$, e.g., approximately 45°, with respect to the light beam of normal incidence. As shown in FIG. 8, the outputs of detectors 32, 33, and 34 are amplified in a plurality of signal amplifiers 41, 42 and 43 and then converted into digital format by a corresponding A-to- D converter 46, 47 and 48. Microprocessor 17, which includes a memory 25, processes the information which is fed to it from the detectors, i.e., the digital representation of the signals $X_1$, Y and Z. As shown in the flow chart of FIG. 10, after checking for the presence of a workpiece the first operation performed by computer 17 is to calculate the spectral response $X_2$ by multiplying the response Z by the factor 0.12 and then summing the value so obtained with $X_1$, to synthesize the desired spectral response X. The computer now has at its disposal the set of classical Tristimulus values, X, Y and Z, which are guaranteed to uniquely represent the colour of the workpiece being measured. The Tristimulus values are next normalized, by means of the following equations:

$$x = \frac{X}{X+Y+Z} \quad (19)$$

$$y = \frac{Y}{X+Y+Z} \quad (20)$$

$$z = \frac{Z}{X+Y+Z}. \quad (21)$$

When these signals are normalized, it naturally follows that:

$$x+y+z=1. \quad (22)$$

The normalized values, x, y and z, for any given colour, represent the chromaticity coordinates in the unit plane chromaticity diagram. Since the unit plane can be represented by a right angle, the rectangle chromaticity coordinates x and y suffice to specify the chromaticity point of any workpiece, regardless of its colour. Therefore, microprocessor 17 need only operate on Equations (19) and (20) to obtain the chromaticity coordinates x and y.

In operation, as shown in FIG. 7 the caps 10 to be sorted are dropped into cylinder 11 one at a time where they are illuminated by light from source 13. The caps 10 reflect the light into the detector assembly 16. Microprocessor 17 then determines (see FIGS. 10A, 10B and 10C) from the output signals from detector assembly 16 the colour of the cap 10 currently aligned with aperture 12. The microprocessor 17 then commands motor 18 to rotate chute 19 so that the cap 10, when released from cylinder 11, will fall into the appropriate one of the bins 21.

The chromaticity diagram, shown in FIG. 5 is stored in the memory of the microprocessor 17 in the form of a plurality of two-dimensional matrices which represent the boundaries of the colours to be identified. These boundaries were established empirically by measuring the chromaticity coordinates of more than 1000 workpieces in various states of cleanliness.

More specifically, after the chromaticity coordinates x and y, of the cap 10 currently illuminated have been computed, memory 25 is searched until a matrix containing both the x and y chromaticity coordinates is identified. If such a matrix is not found, the colour measurement for that particular workpiece is obviously in error. The colour black presents a special problem in that it has almost zero diffuse reflection compared to the ten other colours considered. Thus, to minimize the processing of very small signals, the colour black is identified by looking at the sum of the chromaticity value X+Y+Z (see FIG. 10B). The colours white and grey also present a problem in that they have the same, or almost the same, chromaticity coordinates; therefore, they tend to map into the same matrix. An additional operation is required to complete the identification of white and grey workpieces. That is, the separation of the workpiece by looking at the sum of the chromaticity values X+Y+Z. When this is done it is found that the sum of the chromaticity values for white is larger than that of grey by a factor of 3; thus a grey workpiece may also be identified on the basis of the sum of the chromaticity values. Ivory, on the other hand, may be identified by its own matrix, however, sometimes the chromaticity coordinates for a dirty ivory workpiece falls within the limits defined by the beige matrix; therefore, a separation by the sum of the chromaticity values is also required. Fortunately, this is readily accomplished because, on the basis of the many measurements which were made to establish the chromaticity matrixes, the sum of the chromaticity values for ivory was found to be about 1.5 times larger than that of beige. Upon completion of the matrix identification, and the chromaticity values sum separation, if necessary, microprocessor 17 assigns a binary number from 1 to 12 to the identified colour. This binary number is then compared with the binary number which represents the colour of the cap 10 previously identified. On the basis of this comparison, microprocessor 17 outputs a signal to rotate motor 18 either clockwise or counterclockwise, as required, to achieve the minimal travel time necessary for the rotating chute to align itself with the stationary bin corresponding to the current colour identified. The microprocessor 17 then outputs two additional binary colour codes. The first of these binary numbers corresponds to the colour identified; the second corresponds to the current position of the chute 19. These binary numbers are used to drive a display which informs the operator of the current status of the machine. The final output is a signal which informs the controller that the colour processing has been completed and that the next cap 10 may be released for sorting.

One skilled in the art may make various changes and substitutions without departing from the spirit and scope of the invention.

What is claimed is:

1. A method of sorting workpieces according to their colour, wherein positive colour determination is difficult for certain workpiece colours, comprising the steps of:

(a) advancing a workpiece to be sorted towards a workstation;

(b) directing a beam of light at said workpiece to illuminate the same while said workpiece is positioned at said workstation;

(c) measuring the amplitude of three different spectral components in the light which is diffusely reflected off said workpiece, the first and second ones of said components respectively corresponding to the first and second colours of any set of three colours which satisfy the Tristimulus Theory, said third component corresponding to at least the major lobe of the third one of said set of three colours, which satisfy the Tristimulus Theory;

(d) synthesizing an amplitude which substantially corresponds to the amplitude of the spectral component that would have been measured for the third one of said set of three colours which satisfy the Tristimulus Theory, by adding the amplitude of said third component to a moiety of the amplitude of said first component;

(e) comparing the amplitudes of said first and second spectral components, and said synthesized spectral component, to successive ones of a plurality of sets of spectral component amplitudes each set of which defines a possible colour for said workpiece, thereby to determine the colour of said workpiece when the results of the comparison indicate a match;

(f) summing the amplitudes of said first and second spectral components, and said synthesized spectral component;

(g) additionally comparing the sum of the amplitudes obtained in said summing step to the sum of the amplitudes in those ones of said plurality of sets of spectral component amplitudes of greatest interest, thereby to positively determine the colour of said workpiece when the results of said additional comparison indicate a match;

(h) moving a discharge member, in accordance with the results of steps (c) through (g) until said discharge member is aligned with the receptacle assigned to receive workpieces of said determined colour; and then, (i) releasing said workpiece from said workstation so that said workpiece traverses said discharge member and is received within said receptacle.

2. The method according to claim 1 wherein the workpieces to be sorted are stored in a hopper and dropped one at a time into said workstation, said discharge member having an input end positioned beneath said workstation and an exit end proximate said receptacle and being pivoted for rotation in the horizontal plane, said receptacle comprising one of a plurality of receptacles circumferentially disposed about said workstation, comprising the further steps of:

(j) comparing the colour of the workpiece determined in said determining step with the colour of the previous workpiece so determined and, if said workpiece is of a different colour and;

(k) computing the direction, and degree of rotation, that will move the exit end of said discharge member proximate the receptacle assigned to said determined colour.

3. The method according to claim 1 including the further step of:

(j) normalizing the amplitudes of said first and second spectral components, and said synthesized spectral component, prior to said comparing step.

4. The method according to claim 1 including the further step of:

(j) controlling the colour temperature of the beam of light which is directed onto said workpiece.

5. The method according to claim 3, 1 or 4 wherein said plurality of sets of spectral component amplitudes are priorly obtained by averaging, for each possible colour of workpiece, a plurality of Tristimulus spectral component amplitudes, taken under controlled conditions.

6. The method according to claim 3, 1 or 4 wherein said beam of light has a wavelength spectrum ranging from approximately 380 nm to 770 nm, said first spectral component has a wavelength spectrum ranging from approximately 380 nm to 550 nm, said second spectral component has a wavelength spectrum ranging from approximately 430 nm to 670 nm and said third spectral component has a wavelength spectrum ranging from 500 nm to 770 nm.

7. A method of determining the colour of a workpiece, wherein positive colour determination is difficult for certain workpiece colours, comprising the steps of:

(a) directing a beam of light at said workpiece to illuminate the same;

(b) measuring the amplitude of three different spectral components in the light which is diffusely reflected off said workpiece, the first and second ones of said components respectively corresponding to the first and second colours of any set of three colours which satisfy the Tristimulus Theory, said third component corresponding to at least the major lobe of the third one of said three colours which satisfy the Tristimulus Theory;

(c) synthesizing an amplitude which substantially corresponds to the amplitude of the spectral component that would have been measured for the third one of said set of three colours which satisfy the Tristimulus Theory, by adding the amplitude of said third component to a moiety of the amplitude of said first component;

(d) comparing the amplitude of said first and second spectral components, and said synthesized spectral component, to successive ones of a plurality of sets of spectral component amplitudes each set of which defines a possible colour for said workpiece, thereby to determine the colour of said workpiece when the results of the comparison indicate a match;

(e) summing the amplitudes of said first and second spectral coomponents, and said synthesized spectral component; and then (f) additionally comparing the sum of the amplitudes obtained in said summing step to the sum of the amplitudes in those ones of said plurality of sets of spectral component amplitudes of greatest interest, thereby to positively determine the colour of said workpiece when the results of said additional comparison indicate a match.

8. The method as set forth in claims 1 or 7 wherein the workpiece is a telephone handset cap.

9. The method as set forth in claims 1 or 7 wherein the workpiece is a telephone housing.

10. The method according to claim 7 including the further step of:

(g) normalizing the amplitudes of said first and second spectral components, and said synthesized spectral component, prior to said comparing step.

11. The method according to claim 7 including the further step of:

(g) controlling the colour temperature of the beam of light which is directed onto said workpiece.

12. The method according to claim 10, 7, or 11 wherein said plurality of sets of spectral component amplitudes are priorly obtained by averaging, for each possible colour of workpiece, a plurality of Tristimulus spectral component amplitudes, taken under controlled conditions.

13. The method according to claim 10, 7, or 11 wherein said beam of light has a wavelength spectrum ranging from approximately 380 nm to 770 nm, said first spectral component has a wavelength spectrum ranging from approximately 380 nm to 550 nm, said second spectral component has a wavelength spectrum ranging from approximately 430 nm to 670 nm and said third spectral component has a wavelength spectrum ranging from 500 nm to 770 nm.

14. An apparatus for sorting workpieces according to their colour, wherein positive colour determination is difficult for certain workpiece colours, comprising:

(a) means for advancing a workpiece to be sorted towards a workstation;

(b) means for directing a beam of light at said workpiece to illuminate the same while said workpiece is positioned at said workstation;

(c) means for measuring the amplitude of three different spectral components in the light which is diffusely reflected off said workpiece, the first and second ones of said components respectively corresponding to the first and second colours of any set of three colours which satisfy the Tristimulus Theory, said third component corresponding to at least the major lobe of the third one of said set of three colours, which satisfy the Tristimulus Theory;

(d) means for synthesizing an amplitude which substantially corresponds to the amplitude of the spectral component that would have been measured for the third one of said set of three colors which satisfy the Tristimulus Theory, by adding the amplitude of said third component to a moiety of the amplitude of said first component;

(e) means for comparing the amplitudes of said first and second spectral components, and said synthesized spectral component, to successive ones of a plurality of sets of spectral component amplitudes each set of which defines a possible colour for said workpiece, thereby to determine the colour of said workpiece when the results of the comparison indicate a match;

(f) means for summing the amplitudes of said first and second spectral components, and said synthesized spectral component;

(g) means for additionally comparing the sum of the amplitudes to the sum of the amplitudes in those ones of said plurality of sets of spectral component amplitudes of greatest interest, thereby to positively determine the colour of said workpiece when the results of said additional comparison indicate a match;

(h) means for moving a discharge member until said discharge member is aligned with the receptacle assigned to receive workpieces of said determined colour; and (i) means for releasing said workpiece from said workstation so that said workpiece traverses said discharge member and is received within said receptacle.

15. The apparatus according to claim 14 wherein said light source generates substantial amounts of unwanted infra-red radiation, said apparatus further comprising:

means for filtering from the output of said light source substantially all of said infra-red radiation.

16. The apparatus according to claim 14 wherein said light source comprises an incandescent lamp and said apparatus further comprises:

means for regulating the amount of current fed to the filament of said lamp; and means, connected to said regulating means, for sensing the colour temperature of the light emitted from said lamp thereby to cause said regulating means to maintain a constant colour temperature if the output from said lamp should vary, for whatever reason.

17. The apparatus according to claim 14 wherein said amplitude measuring means comprises:

first, second and third photo-detectors positioned to receive only light which diffusely reflects from said workpiece; and first, second and third optical filters respectively positioned in the optical path of said first, second and third photo-detectors, said first optical filter having a transmission range of from approximately 380 nm to 550 nm, said second optical filter having a transmission range of from approximately 430 nm to 670 nm, and said third optical filter having a transmission range of from approximately 500 nm to 770 nm.

18. The apparatus according to claim 1 wherein said amplitude comparing means comprises a programmed microprocessor and a memory circuit connected to, and driven by, said microprocessor, said amplitude measuring means further comprising:

first, second and third analog-to-digital converters respectively interconnecting the outputs of said first, second and third photo-detectors and an input port of said microprocessor.

19. The apparatus according to claim 18 wherein said sorting means comprises:

a discharge chute having an input end and an exit end, said chute being mounted for rotation about the horizontal plane with the input end thereof proximate said workstation, said plurality of containers being circumferentially arranged around said workstation and aligning with the exit end of said discharge chute; and means, responsive to an output signal from said microprocessor, for rotating said chute to route said workpiece when released from said workstation into the appropriate container for the colour of the workpiece.

20. An apparatus for of determining the colour of a workpiece wherein colour determination is difficult for certain workpiece colours, comprising:

(a) means for directing a beam of light at said workpiece to illuminate the same (b) means for measuring the amplitude of three different spectral components in the light which is diffusely reflected off said workpiece, the first and second ones of said components respectively corresponding to the first and second colours of any set of three colours which satisfy the Tristimulus Theory, said third component corresponding to at least the major lobe of the third one of said three colours which satisfy the Tristimulus Theory;

(c) means for synthesizing an amplitude which substantially corresponds to the amplitude of the spectral component that would have been measured for the third one of said set of three colours which satisfy the Tristimulus Theory, by adding the amplitude of said third component to a moiety of the amplitude of said first component;

(d) means for comparing the amplitude of said first and second spectral components, and said synthesized spectral components, to successive ones of a plurality of sets of spectral component amplitudes each set of which defines a possible colour for said workpiece, thereby to determine the colour of said workpiece when the results of the comparison indicate a match;

(e) means for summing the amplitudes of said first and second spectral components, and said synthesized spectral component; and (f) means for additionally comparing the sum of the amplitudes to the sum of the amplitudes in those ones of said plurality of sets of spectral component amplitudes of greatest interest, thereby to positively determine the colour of said workpiece when the results of said additional comparison indicate a match.

21. Apparatus as set forth in claims 14 or 20, wherein the workpiece is a telephone handset cap.

22. Apparatus as set forth in claims 14 or 20, wherein the workpiece is a telephone housing.

23. The apparatus according to claim 20 wherein said amplitude measuring means comprises:

first, second and third photo-detectors positioned to receive only light which diffusely reflects from said workpiece; and first, second and third optical filters respectively positioned in the optical path of said first, second and third photo-detectors, said first optical filter having a transmission range of from approximately 380 nm to 550 nm, said second optical filter having a transmission range of from approximately 430 nm to 670 nm, and said third optical filter having a transmission range of from approximately 500 nm to 770 nm.

24. The apparatus according to claim 23 wherein said light source generates substantial amounts of unwanted infra-red radiation, said apparatus further comprising:

means for filtering from the output of said light source substantially all of said infra-red radiation.

25. The apparatus according to claim 23 wherein said light source comprises an incandescent lamp and said apparatus further comprises:

means for regulating the amount of current fed to the filament of said lamp; and means, connected to said regulating means, for sensing the colour temperature of the light emitted from said lamp thereby to cause said regulating means to maintain a constant colour temperature if the output from said lamp should vary, for whatever reason.

26. The apparatus according to claim 23 wherein said amplitude comparing means comprises a programmed microprocessor and a memory circuit connected to, and driven by, said microprocessor, said amplitude measuring means further comprising:

first, second and third analog-to-digital converters respectively interconnecting the outputs of said first, second and third photo-detectors and an input port of said microprocessor.

* * * * *

UNITED STATES PATENT AND TRADEMARK OFFICE

CERTIFICATE OF CORRECTION

PATENT NO. : 4,278,538

DATED : July 14, 1981

INVENTOR(S) : H. S. LAWRENCE-J. D. MICHALSKI

It is certified that error appears in the above—identified patent and that said Letters Patent is hereby corrected as shown below:

Column 1, line 27, "idenfity" should read --identify--. Column 2, line 65, "off" should read --of--. Column 2, line 66, "of" should read --off--. Column 3, line 18, "Comission" should read --Commission--. Column 5, line 26, "resilient" should read --resultant--. Column 5, Equation (4), "1,2,3,4" should read --1,2,3,4....--. Column 6, line 45, "Δ" should read --λ--. Column 9, line 56, "T" should read --T--. Column 9, line 63, "T" should read --T--. Column 10, line 29, "spectal" should read --spectral--. Column 20, line 37, "An apparatus for of" should read --An apparatus of--. Column 20, Claim 18, line 13, "claim 1" should read --claim 14--.

Signed and Sealed this

*Seventeenth* Day of *November 1981*

[SEAL]

*Attest:*

GERALD J. MOSSINGHOFF

*Attesting Officer*

*Commissioner of Patents and Trademarks*